United States Patent [19]

Hillebrecht

[11] Patent Number: 4,643,072

[45] Date of Patent: Feb. 17, 1987

[54] SUBMARINE MISSILE EJECT SYSTEM

[75] Inventor: Henry A. Hillebrecht, San Jose, Calif.

[73] Assignee: The United States of America as represented by the Secretary of the Navy, Washington, D.C.

[21] Appl. No.: 740,674

[22] Filed: Jun. 3, 1985

[51] Int. Cl.[4] ..... F41F 3/04

[52] U.S. Cl. ..... 89/1.810; 89/1.818

[58] Field of Search ..... 89/1.810, 1.809, 1.818, 89/1.8

[56] References Cited

U.S. PATENT DOCUMENTS

| | | | |
|---|---|---|---|
| 2,989,899 | 6/1961 | Siegel et al. | 89/1.810 |
| 3,088,377 | 5/1963 | Siegel | 89/1.810 |
| 3,182,554 | 5/1965 | Barakauskas | 89/1.810 |
| 3,183,904 | 5/1965 | Barakauskas | 89/1.810 |
| 3,298,278 | 1/1967 | Barakauskas | 89/1.810 X |
| 4,151,780 | 5/1979 | Andersson | 89/1.7 |
| 4,185,538 | 1/1980 | Barakauskas | 89/1.810 |
| 4,436,016 | 3/1984 | Olmsted et al. | 89/1.818 X |

*Primary Examiner*—David H. Brown

*Attorney, Agent, or Firm*—C. D. B. Curry; R. F. Beers; W. C. Daubenspeck

[57] ABSTRACT

A variable energy missile eject system in which the rate at which cooling water is injected into the hot gas flow from a solid propellant rocket motor may be varied to optimize the eject energy according to launch depth. A first set of injection apertures through which water is always injected provides the necessary cooling and establishes the minimum rate of water injection (maximum launch energy). Additional sets of injection apertures having varying numbers of apertures are individually controlled to allow the water injection rate to be increased by increasing the number of injection apertures.

5 Claims, 12 Drawing Figures

| CLOSED VALVES | CLOSED HOLES 0 | 3 | 6 | 9 | 12 | 15 | 18 | 21 | 24 | 27 | 30 | 33 | 36 | 39 | 42 | 45 | 48 | 51 | 54 | 57 | 60 |
|---|---|---|---|---|---|---|---|---|---|---|---|---|---|---|---|---|---|---|---|---|---|
| | - SHALLOW - | | | | | | | | | | | | | | | | | | - DEEP - | | |
| | VALVE COMBINATIONS | | | | | | | | | | | | | | | | | | | | |
| V1 | / | | | / | | / | | ⊿ | △ | / | △ | △ | △ | / | △ | | / | | / | | |
| V2 | | | / | / | | | / | / | / | ⊿ | △ | | / | ⊿ | / | / | / | | | / | |
| V3 | | | | | / | / | / | / | | | / | ⊿ | ⊿ | ⊿ | / | / | | / | / | / | |
| V4 | | | | | | | △ | △ | / | / | △ | / | / | ⊘ | △ | / | / | / | / | / | |
| V5 | | | | | | | | ○ | △ | △ | △ | / | △ | ⊘ | ⊿ | / | / | / | / | / | |

/ = CLOSED VALVES
△ = OPTION ONE
○ = OPTION TWO

SUBMARINE MISSILE EJECT SYSTEM

BACKGROUND OF THE INVENTION

This invention relates in general to a system for ejecting a missile from a submarine and, in particular, to a system in which the energy imparted to the missile during ejection may be selected according to the launch depth.

Present missile eject systems are fixed energy systems that provide a pressure pulse to launch a missile in a predictable manner. During submerged launches part of the fixed energy is used to overcome static sea head pressure. Thus the velocity of the missile at exit from the launch tube will vary inversely with the launch depth.

It would be desirable if the missile eject velocity could be varied with launch depth, This would allow the missile eject velocity to be optimized for the launch depth in view of submarine shock protection requirements and missile cavitation constraints. This improvement requires that the eject system be capable of altering the amount of energy imparted to the missile.

It is also desirable that the improved system be compatible with a present missile eject system so that the present system may be modified to be capable of altering the amount of energy imparted to the missile. This requires that changes to the present eject system be minimized and that the modifications be easily installed. The modifications should be reliable and should be easily accessible for maintenance. Since this is a submarine system, space and weight requirements should be minimized.

In a prior fixed energy system, hot gas from a solid propellant rocket motor provides the ejection energy. The hot gas is directed through cooling apparatus in which a cooling liquid (water) is injected into the hot gas through a plurality of injection apertures to reduce the temperature of the gas to prevent premature ignition of the missile propellant.

SUMMARY OF THE INVENTION

It is therefore the primary object of the present invention to provide a submarine missile eject system in which the energy applied to the missile may be varied.

Another object of the present invention is to provide a submarine missile eject system in which the missile eject velocity may be optimized for the launch depth.

Another object of the present invention is to provide a missile eject system in which the eject velocity may be increased with launch depth.

Another object of the present invention is to provide a means for modifying a present submarine missile eject system to vary the ejection energy imparted to the missile so that the missile eject velocity may be optimized for the launch depth.

These and other objects are provided by a missile eject system in which the rate at which the cooling liquid is injected into the hot gas from the solid propellant rocket motor may be varied to selectively vary the energy imparted to the missile. The preferred embodiment has a first set of injection apertures through which cooling liquid is always injected and which provides the necessary cooling of the hot gas to prevent premature ignition of the missile propellant. This first set provides the maximum energy to the missile and is used for the deepest launch. Additional sets of injection apertures having varying numbers of injection apertures are individually controlled to allow the rate at which cooling fluid is introduced into the hot gas to be varied according to the launch depth.

The advantages and features of the present invention will become apparent from the following detailed description when considered in conjunction with the accompanying drawings wherein:

DESCRIPTION OF THE PREFERRED EMBODIMENT

Figure 1:
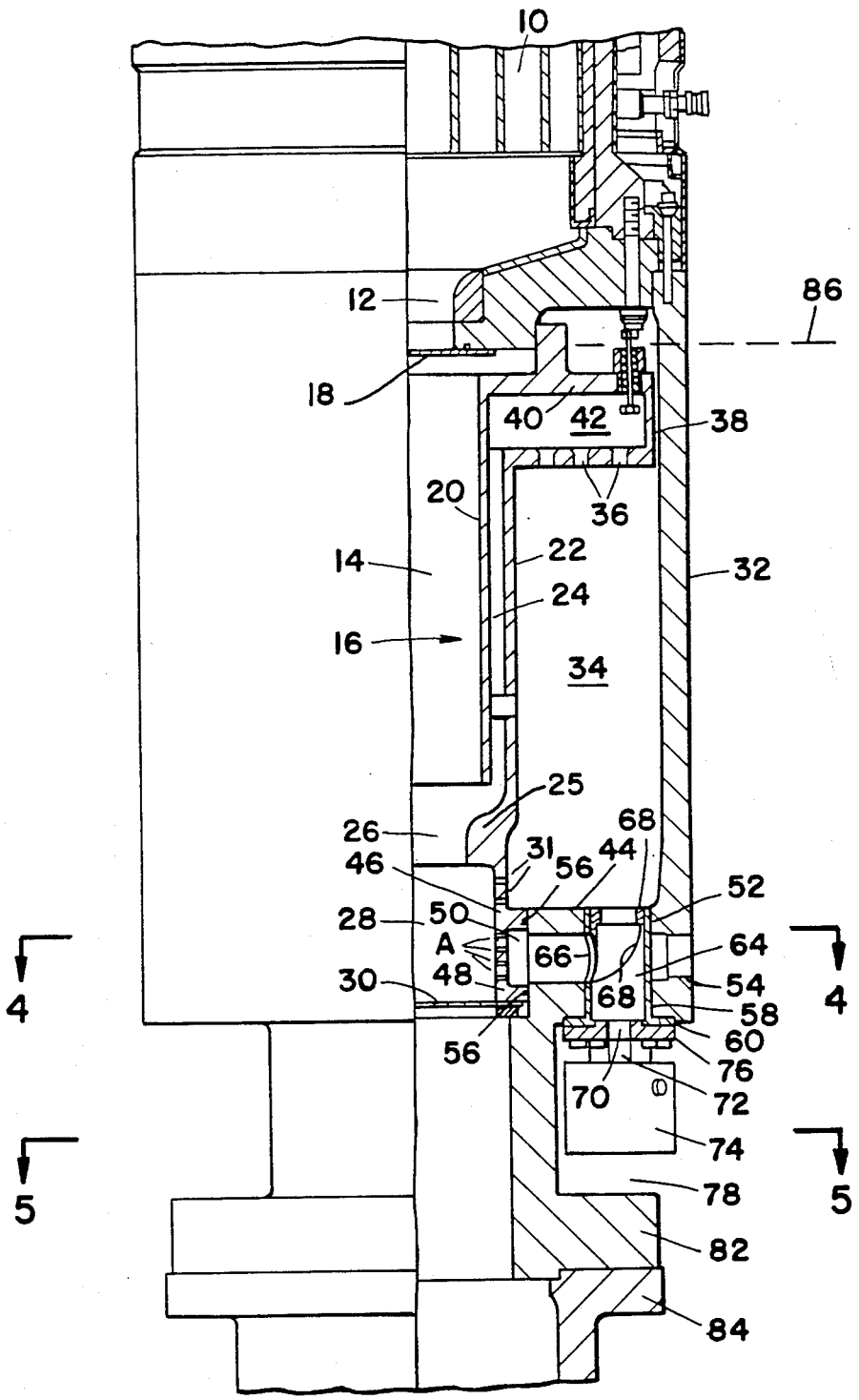
FIG. 1 is a schematic partially cross-sectional view illustrating the variable energy missile eject system.

Referring now to the drawings and, in particular to FIG. 1, the preferred embodiment of the improved missile eject system includes a solid propellant rocket motor 10 having an output nozzle 12 directed into the central chamber 14 of a standpipe 16. A mylar diaphragm 18 is disposed to seal the rocket motor 10 from the central chamber 14. The standpipe 16 is formed by an inner wall 20 and an outer wall 22 to provide an annular channel 24. The outer wall 22 extends below the inner wall 20 and has a section 25 below the end of the inner wall where the inner surface converges to provide a nozzle 26 at the base of the central chamber 14.

Figures 2, 8:
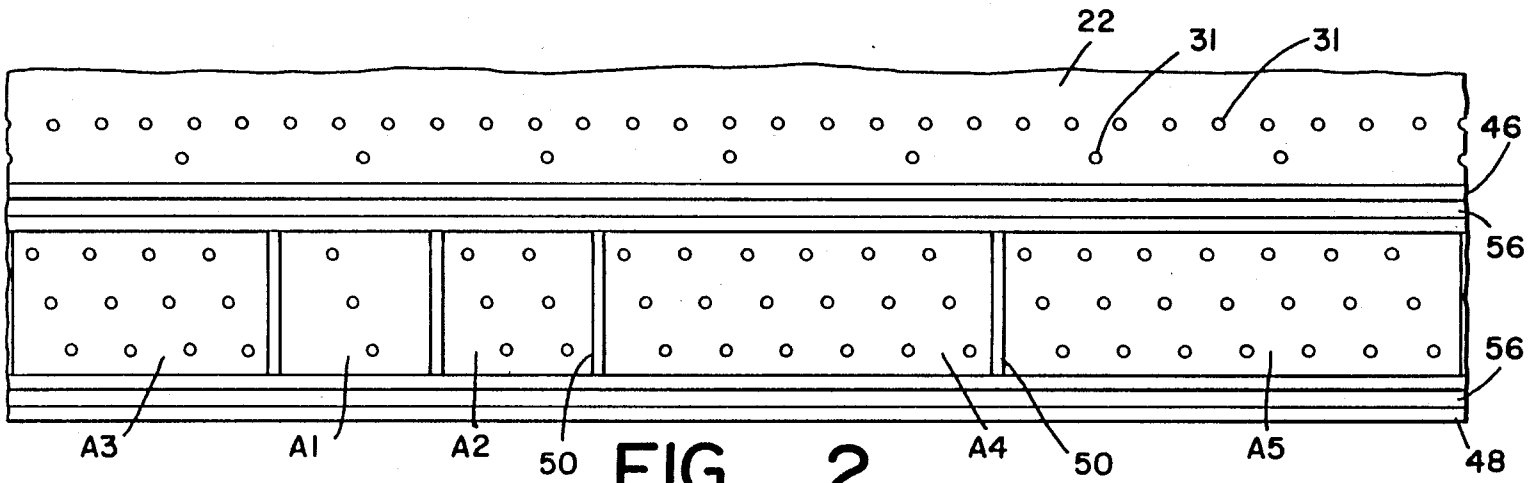
FIG. 2 is a view taken along lines 2—2 in FIG. 3 with the cylindrical surface rolled out to present a plan surface.
FIG. 8 is a table illustrating valve combinations for producing 21 energy levels; and FIGS. *9a–9d* are schematic drawings illustrating the operation of the missile eject system.

Below the nozzle 26, the inner surface of the outer wall 22 diverges to form a water injection chamber 28. A second burst diaphragm 30 is disposed across the base of the water injection chamber 28. The wall of the water injection chamber 28 has a first group of injection apertures 31, best illustrated in the rollout view of FIG. 2, which are circumferentially-spaced around the chamber immediately below the nozzle 26. Thirty-eight apertures are provided in the preferred embodiment. In order to illustrate the vertical placement of the injection apertures in FIGS. 1 and 3, these Figs. show the injection apertures in a common vertical section rather than their actual azimuthal position as illustrated in FIG. 2.

The standpipe 16 is disposed within a housing 32 which forms a cooling chamber 34 around the standpipe. The annular channel 24 is in fluid communication with cooling chamber 34 through circumferentially-spaced apertures 36 in an annular baffle plate 38. The baffle plate 38 is joined to an annular flange 40 at the top of the inner wall 20 to form an annular chamber 42. The standpipe 16 and housing 32 are joined to the rocket motor 10 by suitable fastening means which are illustrated but are not numbered. The cooling chamber 34 extends to just below the first set of injection apertures 31 in the wall of the water injection chamber 28. The housing 32 has an inwardly extending flange 44 which is joined to an outwardly extending horizontal rib 46 of the outer wall 22 to form the bottom of the cooling chamber 34. The injection apertures 31 allow fluid communication between the bottom of the cooling chamber 34 and the water injection chamber 28.

Figure 3:
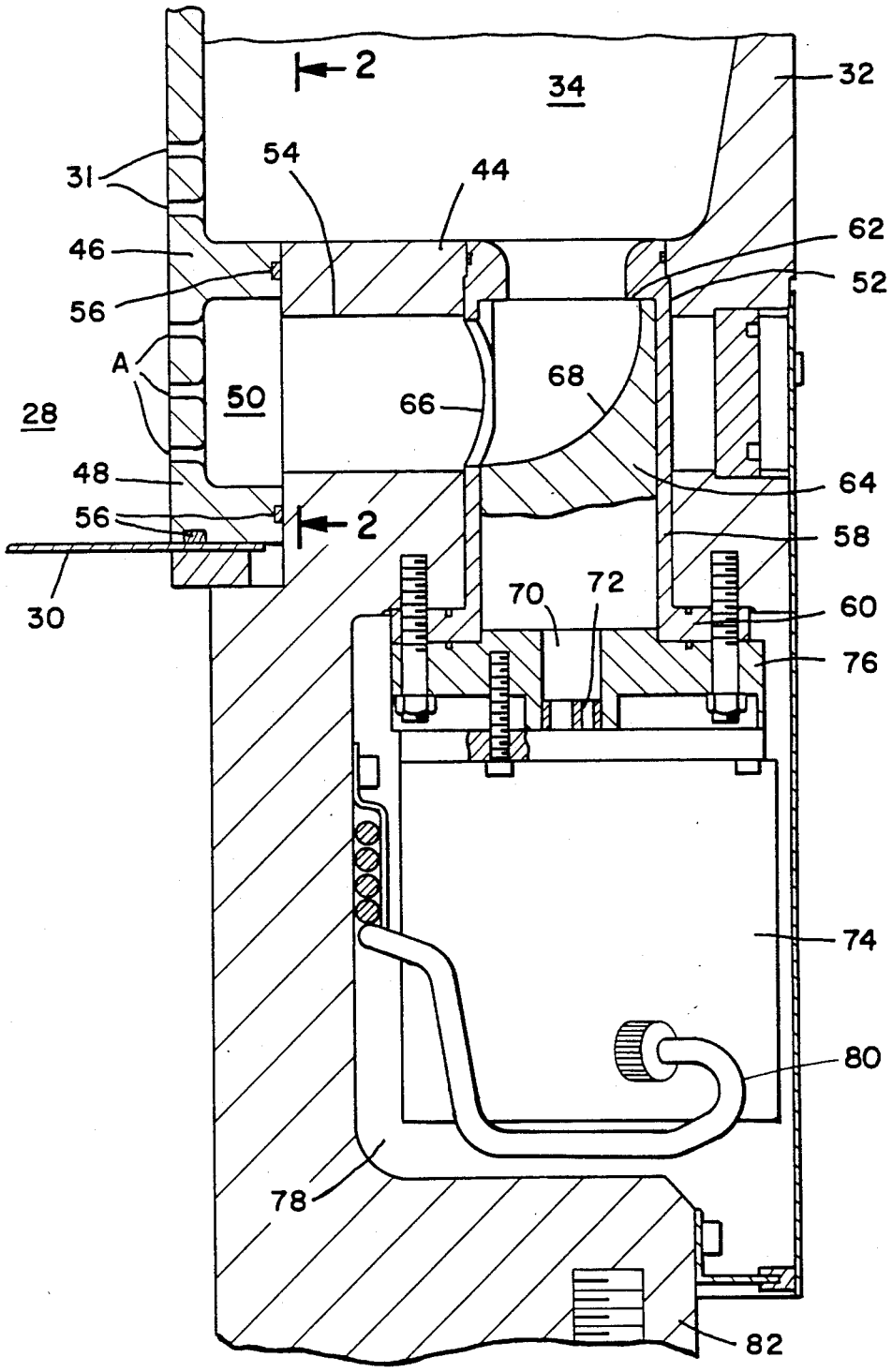
FIG. 3 is an expanded schematic view of a rotary valve assembly and its associated water injection apertures.
Figure 4:
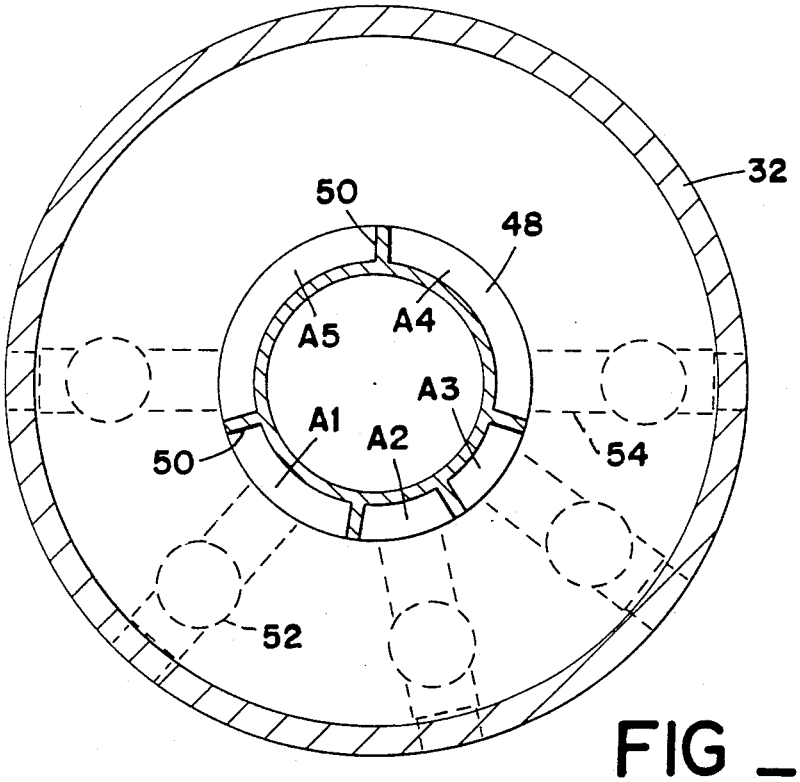
FIG. 4 taken along line 4—4 in FIG. 1 is a schematic cross-sectional view illustrating the location of the valve assemblies and associated injection apertures viewed from the top.

The above-described structure is substantially the same as that employed in the prior missile eject system which the present invention is intended to modify. The improved missile eject system further includes additional injection apertures and valve assemblies for selectively controlling the injection of fluid through the additional apertures. Five groups of injection apertures, A1–A5, are disposed circumferentially in the wall of the water injection chamber 28 below the horizontal rib 46. As shown in FIG. 2, group A1 has 3 apertures, group A2 has 6 apertures, group A3 has 12 apertures, group A4 has 18 apertures, and group A5 has 21 apertures. Each group of injection apertures, A1–A5, is surrounded by the top horizontal rib 46, a bottom horizontal rib 48, and vertical ribs 50 which meet with the inwardly extending flange 44 to enclose the apertures. As best shown in FIGS. 3 and 4, the housing 32 below the cooling chamber 34 has five vertical bores 52 disposed circumferentially in the inwardly extending flange 44. The housing 32 additionally has five radial horizontal bores 54 which intersect the vertical bores 52 and provide a passage between each vertical bore and one group of injection apertures, A1–A5, to the injection chamber 28. O-ring seals 56 are provided to seal each group of apertures A1–A5 and its associated passage between the cooling chamber 34 and the injection chamber 28.

Figure 5:
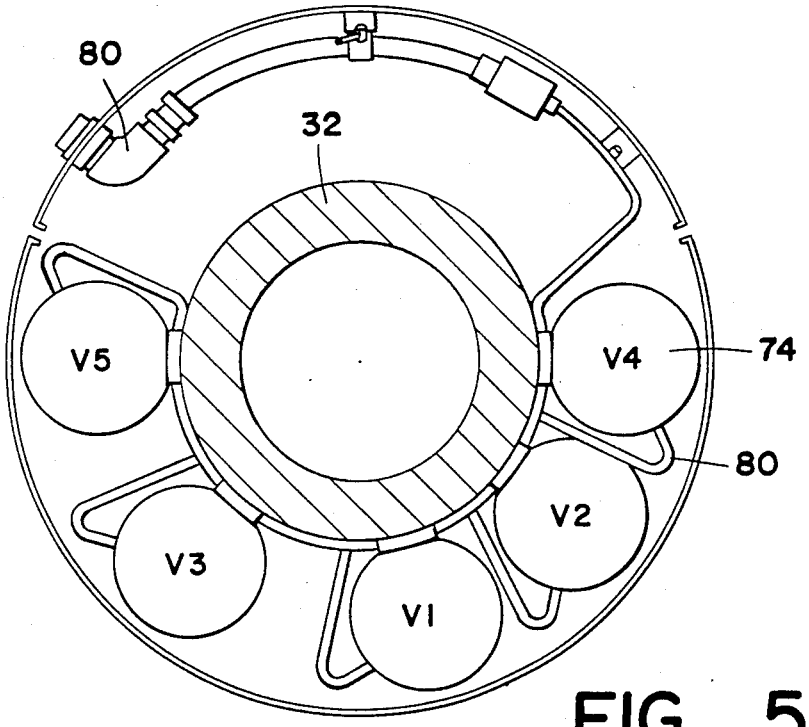
FIG. 5 is a cross-sectional view taken along lines 5—5 in FIG. 1.

As shown in FIGS. 4 and 5, a rotary valve assembly V1–V5 is disposed in each vertical bore 52. The preferred valve assembly includes a cylindrical sleeve 58 having an outward flange 60 at the base for attaching the sleeve to the housing 32 and an inward flange 62 at the top for retaining a rotary valve element 64 in the sleeve. The sleeve has a circular opening 66 which communicates with the horizontal bore 54. The rotary element 64 is a cylinder having a curved channel 68 which provides a smooth fluid-flow path from the cooling chamber 34 to the horizontal bore 54 when the valve is open and closes this path when the rotary element is rotated 180° to the valve—closed position. The rotary element 64 has a slotted shaft 70 for mating with the drive shaft 72 of a rotary actuator 74. The rotary actuator 74, the cylindrical sleeve 58 and the rotary element 64 are secured in place by a mounting plate 76.

Figure 6:
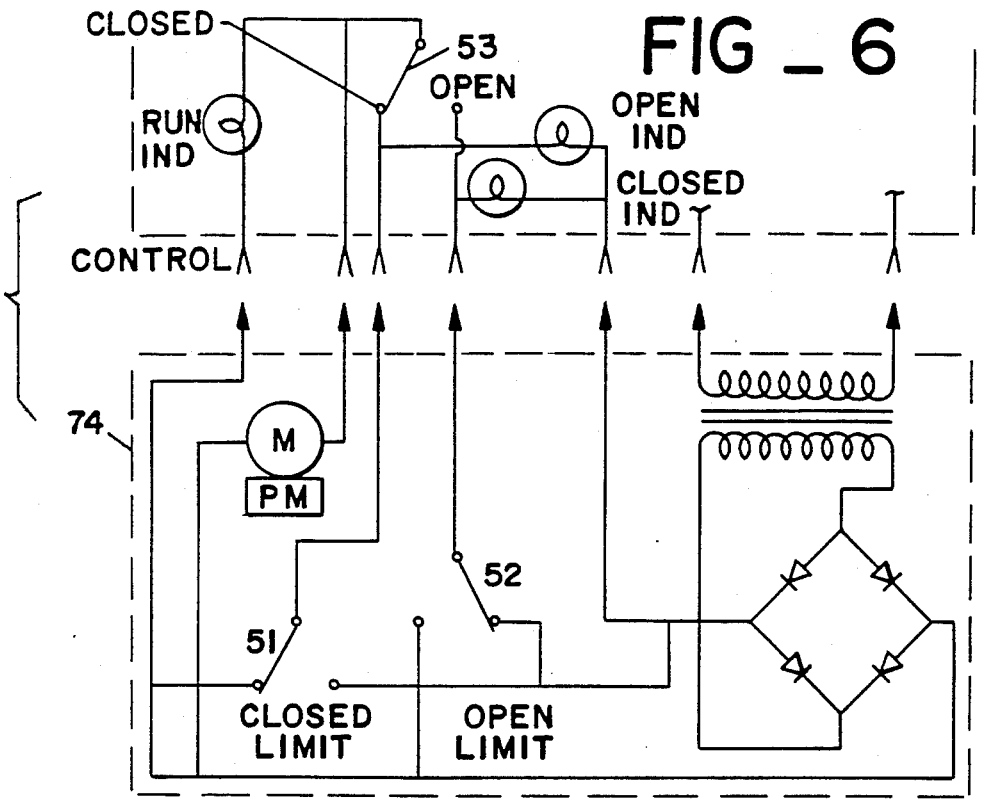
FIG. 6 is a schematic drawing illustrating a rotary actuator drive circuit.

The preferred rotary actuator 74 is a permanent magnet D.C. motor having travel stops at open and closed positions. FIG. 6 illustrates a suitable control circuit with the control switches 51, 52, and 53 set to position the actuator 74 in the closed position. The housing 32 has an annular cavity 78 shown in FIG. 3 in which the rotary actuators 74 are disposed and which allows access to each valve assembly. FIG. 5 illustrates the positions of the rotary actuators 74 and the electrical cables 80 connected thereto in the housing 32.

Figure 7:
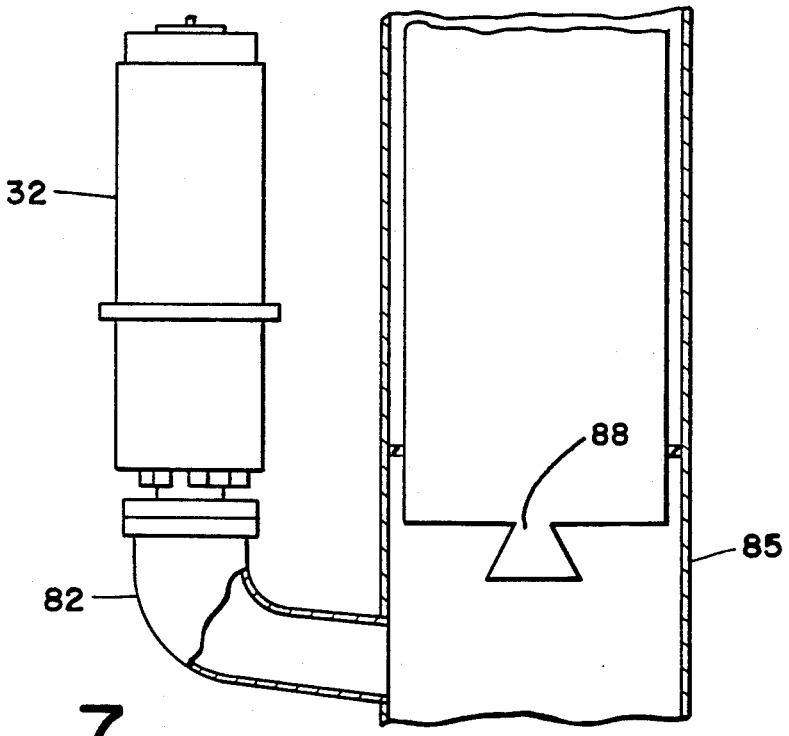
FIG. 7 is a diagramatic view showing the missile eject system coupled to a missile launch tube.
Figure 9A:
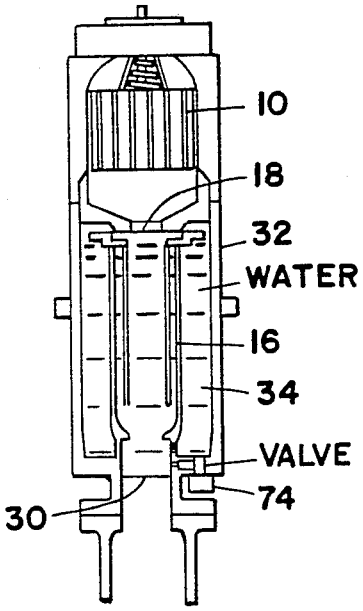
Figure 9B:
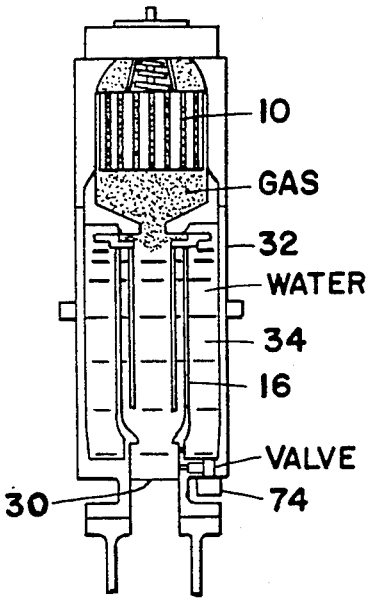
Figure 9C:
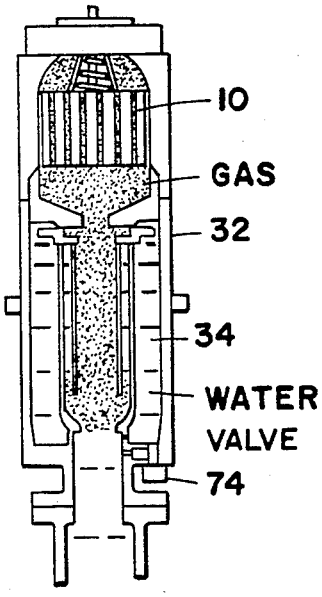
Figure 9D:
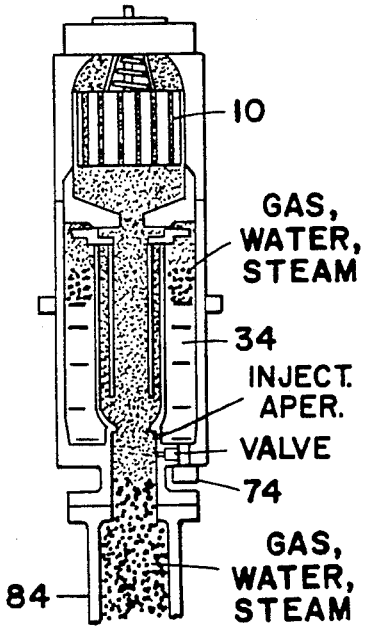

The housing 32 is coupled at the base 82 to the missile launch tube 85 so that the output of the mixing chamber is directed into the launch tube. FIG. 7 shows the missile eject system coupled to a missile launch tube 85.

The operation of the improved missile eject system is illustrated in FIGS. *9a–9d*. Prior to activation of the system as shown in FIG. *9a*, the standpipe 16 and the cooling chamber 34 are filled with a cooling fluid, normally water, to a level near the top of the cooling chamber such as indicated by low full level 86 in FIG. 1. The lower burst diaphragm 30 seals the fluid in the standpipe 16 and the cooling chamber 34. The upper diaphragm 16 separates the rocket motor 10 from the cooling liquid.

When it is desired to eject the missile, the gas generator 10 is activated. The hot gas produced thereby bursts the upper diaphragm 18 and flows through nozzle 12 into the central chamber 14 of the standpipe 16, creating pressure on the surface of the cooling liquid within the central chamber 14 as illustrated in FIG. *9b*. As soon as the pressure on the surface of the cooling liquid reaches the burst pressure of the lower diaphragm 30, the diaphragm ruptures and the cooling liquid within the central chamber 14 is ejected from the standpipe 16 through the lower nozzle 26 (see FIG. *9c*). The nozzle 26 provides an increase in the flow velocity which decreases the pressure at the downstream side of the nozzle in the water injection chamber 28. The higher pressure above the nozzle 30 is transmitted through the annular channel 24 to the top of the liquid in the cooling chamber 34. The difference in pressure between the liquid in the cooling chamber 34 and the hot gas in the injection chamber 28 causes the liquid in the cooling chamber to be injected through the injection apertures to provide a metered injection of the cooling liquid into the hot gas in the injection chamber as shown in FIG. *9d*. The water injection apertures provide that the cooling water injected into the hot gas at a controlled continuous rate. The injected water cools the hot gas so that the resulting gas/water/steam mixture which comes in contact with the missile nozzle 88 (see FIG. 7) is at a sufficiently low temperature so that it will not cause premature ignition of the missile propellant.

The present invention varies the eject energy applied at the missile by selectively varying the rate at which water from the cooling chamber 34 is injected into the hot gas flow from the rocket motor 10. As illustrated in FIG. 8, the maximum launch energy is provided when all the valves are closed so that water from cooling chamber 34 is injected into the hot gas only through the thirty-eight apertures in the first set of water injection apertures 31. The fact that the apertures 31 are always open ensures that sufficient water is injected into the hot gas to prevent the injection of gas into the launch tube at an excessively high temperature. The metered injection of additional cooling water through additional apertures reduces the energy imparted to the missile. As is apparent from FIG. 8, the position of the valves V1–V5 can be selected so that cooling liquid may be injected through from 3 to 60 (in steps of 3) additional injection apertures. The disclosed arrangement provides 21 different eject energies.

Prior to the launch, the position of the valves is selected to provide the best energy for the expected depth of launch. All valves are normally open to provide the minimum eject energy rather than the maximum energy in the event of a malfunction in the valve control system. For example, if fifteen additional injection apertures are desired, the valve element 60 of the valve assemblies associated with aperture group A1 aperture group A4, and aperture group A5 are rotated 180 degrees from the open position shown in FIG. 1 to the closed position. The valves associated with aperture groups A2 and A3 remain in the open position to allow the water to be injected from the cooling chamber 34 into the injection chamber 28 through the fifteen apertures in groups A2 and A3. After the rocket motor is ignited, the pressure differential between the water injection chamber 28 and the cooling chamber 34 causes the injection of the cooling fluid through the thirty-eight apertures which are always open and also through the fifteen apertures controlled by valves V1 and V3. The injection of the fluid cools the hot gas from the rocket motor 10 and reduces the pressure of the gas/-liquid/steam mixture which is coupled to the missile launch tube.

What is claimed is:

1. A variable energy missile eject missile system comprising:

(a) a solid propellant rocket motor having an outlet nozzle; and cooling apparatus including;

(b) a standpipe having an inner wall forming a central chamber which is disposed to receive the hot gas from the outlet nozzle of the rocket motor, said standpipe having an outer wall disposed to form an annular channel between said inner wall and said outer wall, said outer wall extending below said inner wall, the inner surface of the outer wall converging to form a nozzle at the base of the central chamber;

(c) a housing disposed around said standpipe and forming a cooling chamber between said outer wall and said housing, said cooling chamber extending below the nozzle of said standpipe, said central chamber being in communication with said cooling chamber through said annular channel;

(d) a fluid injection chamber disposed below the nozzle of said standpipe, said injection chamber formed by the inner surface of said outer wall extending below the nozzle of the standpipe, said injection chamber having a first set of injection apertures communicating with said cooling chamber, said first set of injection apertures being disposed circumferentially around said chamber immediately below said nozzle, said injection chamber having at least one additional set of apertures disposed in its wall;

(e) said cooling chamber extending to just below said first set of apertures so that said first set of apertures communicates between said cooling chamber and said injection chamber, said housing having an inwardly extending flange which is joined to a first outwardly extending horizontal rib of the outer wall to form the bottom of the cooling chamber;

(f) the wall of said injection chamber having a second horizontal rib disposed below said first horizontal rib, said second horizontal rib being joined to said inwardly extending flange, and said at least one additional set of apertures being disposed in the wall of said injection chamber below said first horizontal rib and above said second horizontal rib;

(g) means for selectively establishing communication between said cooling chamber and said injection chamber through said at least one additional set of apertures including valve means disposed between said cooling chamber and said at least one additional set of apertures, said valve means being disposed in a passage in said inwardly extending flange which communicates between said cooling chamber and said at least one additional set of apertures;

(h) said passage being formed by a vertical bore in said inwardly extending flange and an intersecting radial bore in said flange, said valve means comprising rotary valve means including a cylindrical sleeve disposed in said vertical bore, said sleeve having an opening which communicates with the horizontal bore, a cylindrical rotary element disposed in said cylindrical sleeve, said rotary element having a curved channel which provides a smooth fluid-flow path from the cooling chamber to the horizontal bore when said valve is open and closes said path when said valve is closed, and a rotary actuator coupled to rotate said rotary element to the valve open or valve closed position; and (i) a burst diaphram disposed at the base of the injection chamber to seal said injection chamber, said cooling apparatus being filled with cooling liquid above said diaphram.

2. Apparatus as recited in claim 1 wherein said housing has a plurality of passages communicating between said cooling chamber and said plurality of additional sets of apertures and wherein said means for selectively establishing communication between said cooling chamber and said injection chamber through said at least one additional set of apertures includes a plurality of sets of apertures.

3. Apparatus as recited in claim 2 wherein each of said plurality of passages are formed by a vertical bore in said inwardly extending flange and an intersecting radial bore in said flange and said valve means includes rotary valve means comprising:

(a) a cylindrical sleeve disposed in said vertical bore, said sleeve having an opening which communicates with the horizontal bore;

(b) a cylindrical rotary element disposed in said cylindrical sleeve, said rotary element having a curved channel which provides a smooth fluid-flow path from the cooling chamber to the horizontal bore when said valve is open and closes said path when said valve is closed; and (c) a rotary actuator coupled to rotate said rotary element to the valve open or valve closed position.

4. Apparatus as recited in claim 3 wherein each of said plurality of sets of apertures has a different number of apertures.

5. A variable energy missile eject missile system comprising:

(a) a solid propellant rocket motor having an outlet nozzle; and cooling apparatus including;

(b) a standpipe having an inner wall forming a central chamber which is disposed to receive the hot gas from the outlet nozzle of the rocket motor, said standpipe having an outer wall disposed to form an annular channel between said inner wall and said outer wall, said outer wall extending below said inner wall, the inner surface of the outer wall converging to form a nozzle at the base of the central chamber;

(c) a housing disposed around said standpipe and forming a cooling chamber between said outer wall and said housing, said cooling chamber extending below the nozzle of said standpipe, said central chamber being in communication with said cooling chamber through said annular channel;

(d) a fluid injection chamber disposed below the nozzle of said standpipe, said injection chamber formed by the inner surface of said outer wall extending below the nozzle of the standpipe, said injection chamber having a first set of injection apertures communicating with said cooling chamber, said first set of injection apertures being disposed circumferentially around said chamber immediately below said nozzle, said injection chamber having a plurality of additional sets of apertures disposed in its wall;

(e) said cooling chamber extending to just below said first set of apertures so that said first set of apertures communicates between said cooling chamber and said injection chamber, said housing having an inwardly extending flange which is joined to a first outwardly extending horizontal rib of the outer wall to form the bottom of the cooling chamber;

(f) the wall of said injection chamber having a second horizontal rib disposed below said first horizontal rib, said second horizontal rib being joined to said inwardly extending flange, and said plurality of additional set of apertures being disposed in the wall of said injection chamber below said first horizontal rib and above said second horizontal rib, the wall of said injection chamber having a plurality of outwardly extending vertical ribs, said vertical ribs being joined to the inwardly extending flange, each of said plurality of additional sets of apertures being disposed in the wall of the injection chamber between a first horizontal rib, a second horizontal rib, and two vertical ribs;

(g) means for selectively establishing communication between said cooling chamber and said injection chamber through said plurality of additional sets of injection apertures; and (h) a burst diaphram disposed at the base of the injection chamber to seal said injection chamber, said cooling apparatus being filled with cooling liquid above said diaphram.

* * * * *